US006219866B1

(12) United States Patent
Pascal

(10) Patent No.: US 6,219,866 B1
(45) Date of Patent: Apr. 24, 2001

(54) INFANT LAPMATE

(76) Inventor: Leroy Pascal, 5203 Shenandoah Ave., Los Angeles, CA (US) 90056

( * ) Notice: Subject to any disclaimer, the term of this patent is extended or adjusted under 35 U.S.C. 154(b) by 0 days.

(21) Appl. No.: 09/277,581

(22) Filed: Mar. 29, 1999

(51) Int. Cl.[7] ..... A47D 13/00; A47D 7/01; A47C 19/04

(52) U.S. Cl. ..... 5/655; 5/201; 108/93

(58) Field of Search ..... 5/655, 201, 603; 108/93, 65; 312/205; 297/440.24

(56) References Cited

U.S. PATENT DOCUMENTS 2,696,246 * 12/1954 Putnam ..... 108/93
2,790,184 * 4/1957 Testa ..... 108/65
3,064,373 * 11/1962 Spain ..... 108/93
3,138,403 * 6/1964 Danielson ..... 108/93
3,916,802 * 11/1975 Virtue et al. ..... 5/655
5,222,780 * 6/1993 Reh et al. ..... 108/93

* cited by examiner

*Primary Examiner*—Alexander Grosz

(57) ABSTRACT

An apparatus for administrating infant care comprised of three flat members that create a rigid and lightweight surface sized to properly support an infant. The three flat members are connected to each other in a way that allows the three flat members to be stored inside each other reducing the size of the apparatus for storage.

5 Claims, 8 Drawing Sheets

INFANT LAPMATE

BACKGROUND OF THE INVENTION

1. Field of the Invention

This invention relates to an apparatus for assisting with the various tasks of infant care wherein a portable surface would make said tasks easier to perform. In particular, this invention relates to an apparatus that is rigid and lightweight having a design that allows said apparatus to be utilized, stored and transported without sacrificing durability, safety and ease of use.

2. Description of Related Art

There is an ever increasing need for a means by which childcare can be administered in remote or mobile situations absent designated locations and complicated devices. Currently there are three types of apparatus that can assist caregivers in the administration of such care to infants. There are stationary inventions specifically designed for administering care to infants at designated locations, such as bathrooms or playpens. There are also portable inventions designed for other purposes that some try to use when administering childcare such as pads and pillows. Finally, there are portable inventions designed for the administration of childcare.

Considering the aforementioned types of inventions various background art and the following patents were considered: U.S. Pat. No. 3,721,434 issued to Spies in 1973, U.S. Pat. No. 4,712,258 issued to Eves in 1987 and U.S. Pat. No. 4,935,973 issued to Berhman in 1989.

U.S. Pat. No. 3,721,434 issued to Spies in 1973 is an infant changing board. Spies allows for storage and portability in a traditional and common folding mechanism. Spies claims two rigid boards hinged together with fabric or a soft piece of material. This hinge mechanism while functional reduces the durability of the invention. In addition as claimed, Spies does not prevent the invention from opening along the hinged section and subsequently closing while the infant is placed on the board.

U.S. Pat. No. 4,712,258 issued to Eves in 1987 is a baby changing mat. Eves claims a baby changing mat that is flexible except along a middle stabilized section and as discussed in the issued patent is intended to be used on a substantially rigid horizontal surface that can support the infant. As claimed, in order for Eves to provide a rigid surface suitable for administering childcare it must be used in conjunction with a rigid surface. Eves does include a means for storage wherein the invention is folded along an axis creating a bag, but again this is accomplished using hinges as well as the use of straps and handles for carrying.

U.S. Pat. No. 4,935,973 issued to Berhman in 1989 is an infant changing board designed to be used in conjunction with an infant carrier. As claimed this invention requires the infant carrier (car seat) to provide the foundation by which the changing board is supported. Similarly to the other inventions, storage requires folding allowed by the inclusion of hinges and flaps.

In addition where Spies, Eves and Berhman teach that the use of straps to secure the infant to the respective inventions for safety the current invention goes against this teaching and does not include straps for safety. Taking into consideration the mobile nature and varied situations where this invention will be used it is in the best interest of the caregiver to be able to remove the child from the board quickly. An emergency situation requiring the caregiver to pick up or move the infant would be hindered if the infant were to be attached to a planar element at least as long as the child itself.

It is not in the scope of the background art to have an embodiment that can be stored and easily transported without the need for hinges, flaps or folding parts. None of which the present invention require or claim. Considering the need for an apparatus that is functionally independent, lightweight, easily concealed, easily accessible and safe, this inventor has created an apparatus that provides all of these attributes.

SUMMARY OF THE INVENTION

The present invention provides an apparatus for administering care to an infant that is portable, easily accessible and safe. While ultimately comprised of two or more pieces the present invention functions as a single unit requiring no assembly. From its stored embodiment the present invention requires one step to reveal and create a surface that is rigid, sanitary and suitable for administering care to an infant, absent latches, hinges or removable parts. This invention allows for rapid utilization, as the administration of childcare often requires.

Containing no folding parts or hinges to wear out the current invention has increased structural integrity and durability over the background art. A further benefit of the current invention is that the method of collapsing the device can reduce the invention to half its size for easy storage and transport without sacrificing safety or ease of use.

In one embodiment the invention is comprised of three planar members that are joined together in a manner that allows them to form a single rigid surface for the administration of childcare.

As it is an object of this invention to provide an apparatus that is portable and easily accessible the manner of connection allows the three planar members to be stored inside each other. The resulting stored invention is approximately one third of the size of the invention in the administration position, thereby allowing for easy storage and portability.

In other embodiments the tops of the three rectangular members can be individually lightly padded and/or contoured to create a more natural environment for the infant as opposed to a completely flat surface. Optionally all three rectangular members can be covered by a contoured pad.

Preferred embodiments of the apparatus are formed from a rigid, lightweight plastic. However, in alternative embodiments, other materials, such as metal, alloys, wood or composites materials may be used.

Other objects and advantages besides those discussed above shall be apparent to those experienced in the art from the description of the preferred embodiment of the invention which follows. In the description, reference is made to the accompanying drawings, which form a part hereof, and which illustrate one example of the invention. Such example, however, is not exhaustive of the various alternative forms of the invention, and therefore reference is made to the claims which follow the description for determining the scope of the invention.

BRIEF DESCRIPTION OF THE DRAWINGS

A detailed description of embodiments of the invention will be made with reference to the accompanying drawings, wherein like numerals designate corresponding parts in the several figures. The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

Figure 1:
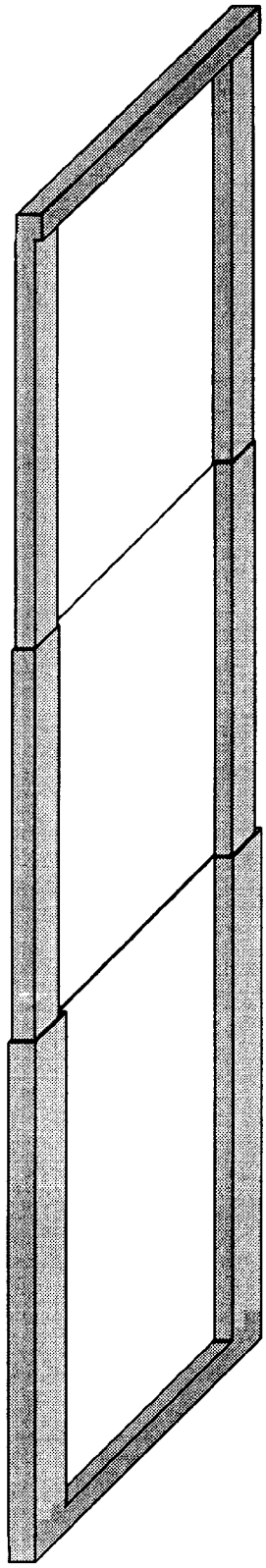
FIG. 1 is a perspective view of the invention in accordance with a first embodiment.
Figure 2:
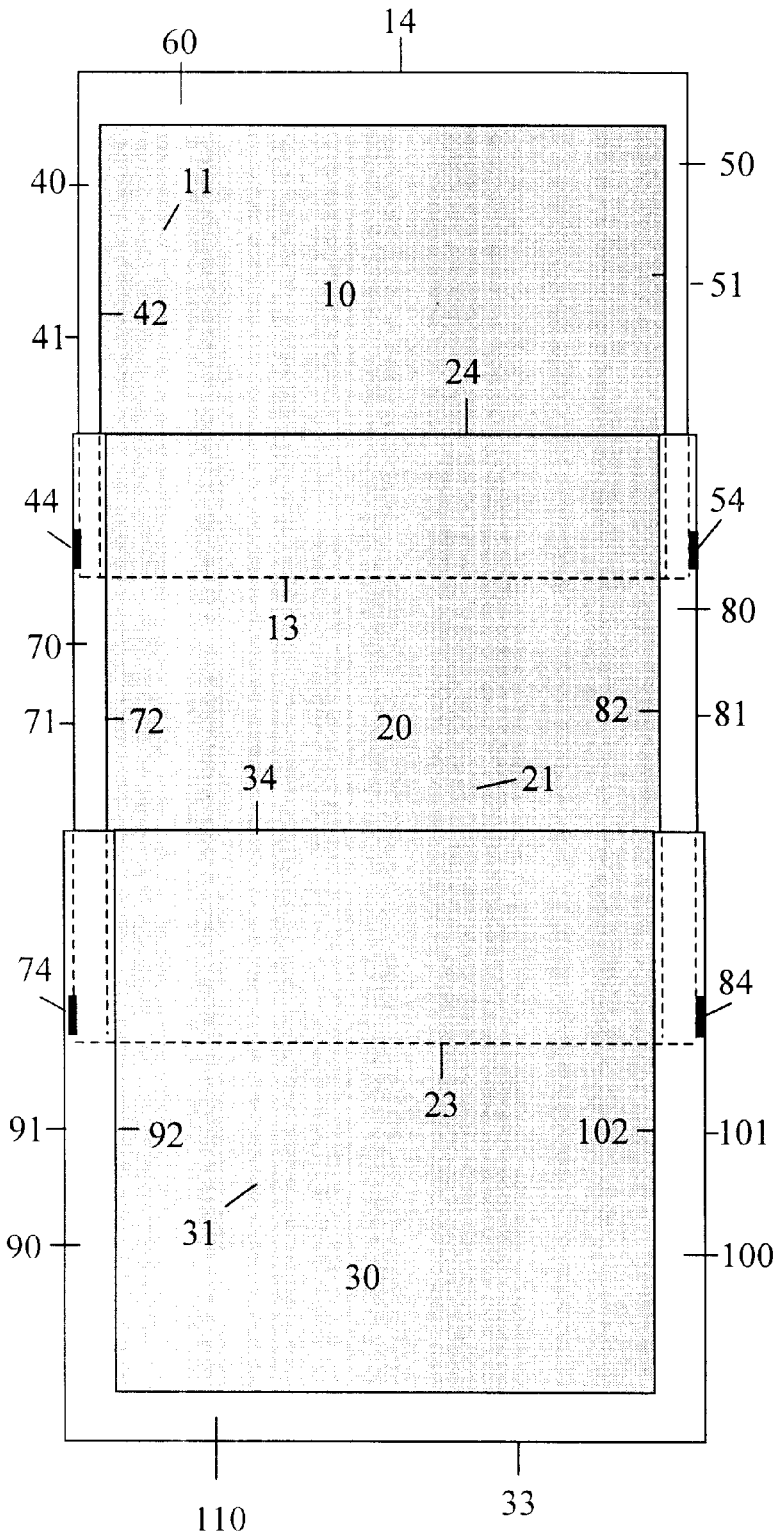
FIG. 2 is a top perspective view of the invention of the first embodiment shown in FIG. 1.
Figure 3:
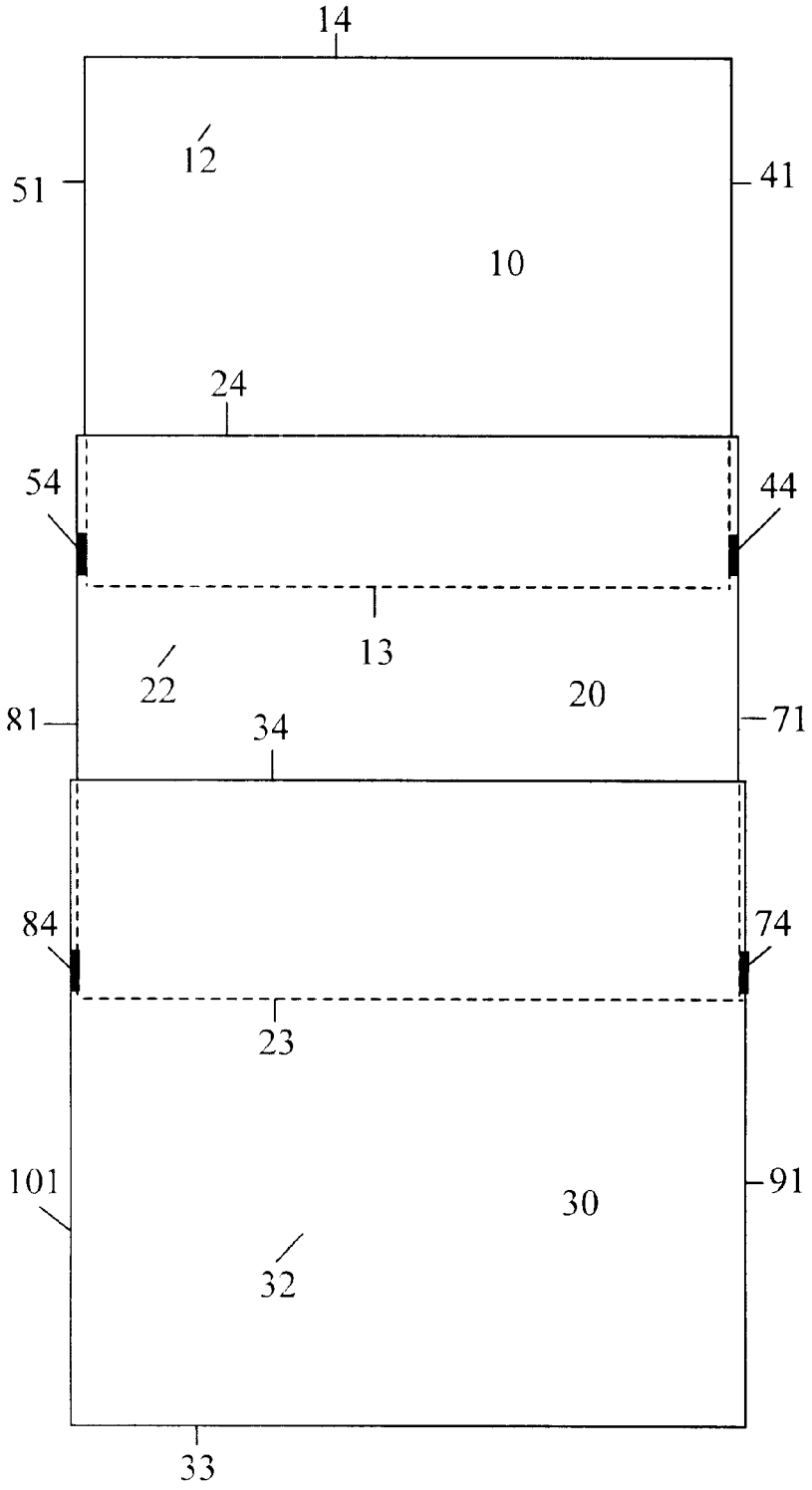
FIG. 3 is a bottom perspective view of the invention of the first embodiment shown in FIG. 1.
Figure 4:
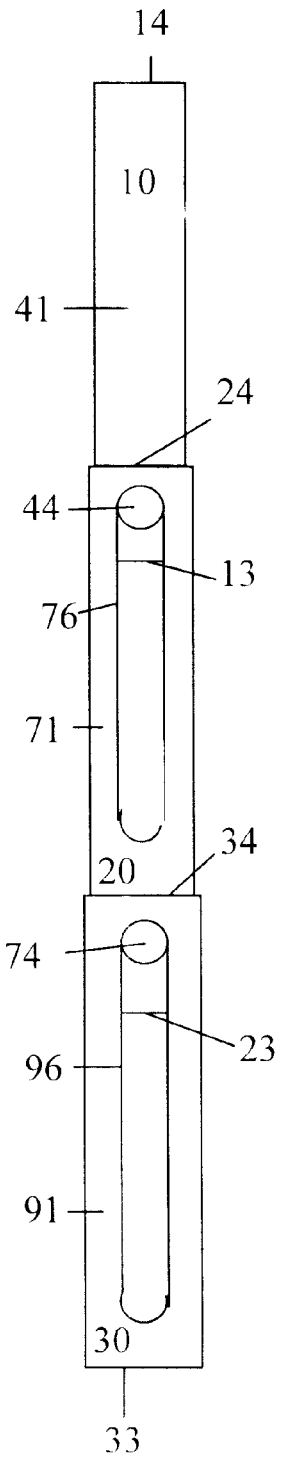
FIG. 4 is a front side anterior head-on view of the invention of the first embodiment shown in FIG. 1.
Figure 5:
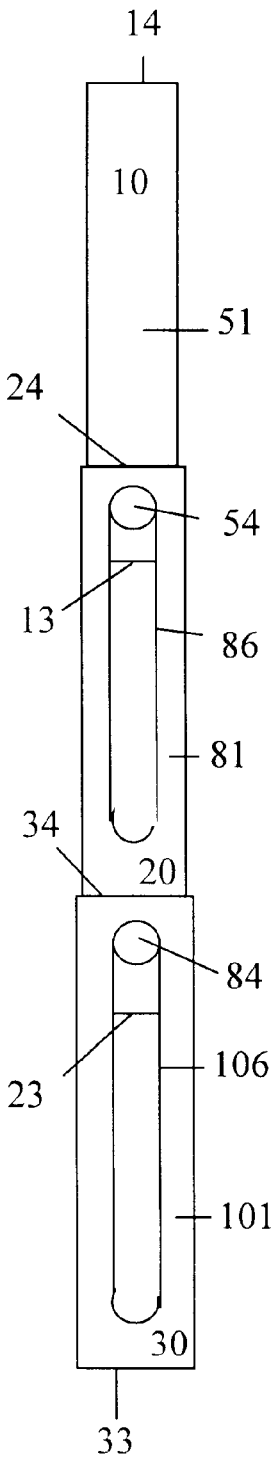
FIG. 5 is a back side anterior head-on view of the invention of the first embodiment shown in FIG. 1.
Figure 6:
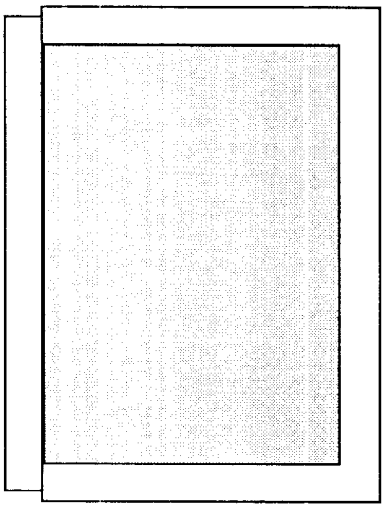
FIG. 6 is a top perspective view showing the invention of the first embodiment shown in FIG. 1 after the inner planar member has been collapsed inside the hollow middle planar member, which in turn is collapsed inside the hollow outer planar member reducing the invention to its stored embodiment.
Figure 7:
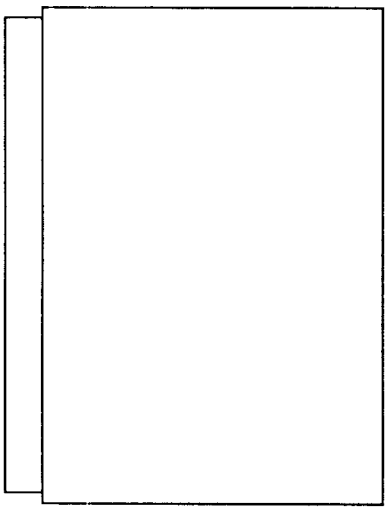
FIG. 7 is a bottom perspective view showing the invention of the first embodiment shown in FIG. 1 after the inner planar member has been collapsed inside the hollow middle planar member, which in turn is collapsed inside the hollow outer planar member reducing the invention to its stored embodiment.
Figure 8:
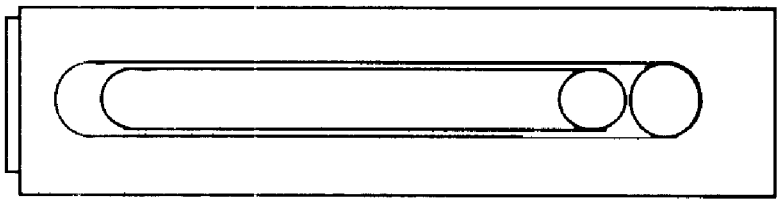
FIG. 8 is a front side anterior head-on view showing the invention of the first embodiment shown in FIG. 1 after the inner planar member has been collapsed inside the hollow middle planar member, which in turn is collapsed inside the hollow outer planar member reducing the invention to its stored embodiment.
Figure 9:
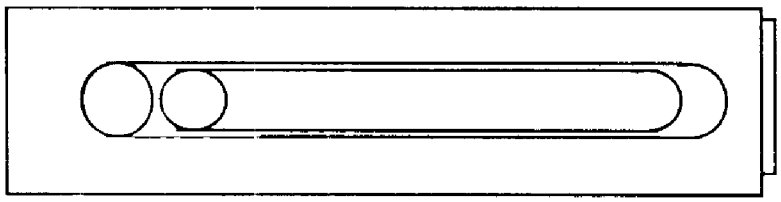
FIG. 9 is a back side anterior head-on view showing the invention of the first embodiment shown in FIG. 1 after the inner planar member has been collapsed inside the hollow middle planar member, which in turn is collapsed inside the hollow outer planar member reducing the invention to its stored embodiment.
Figure 10:
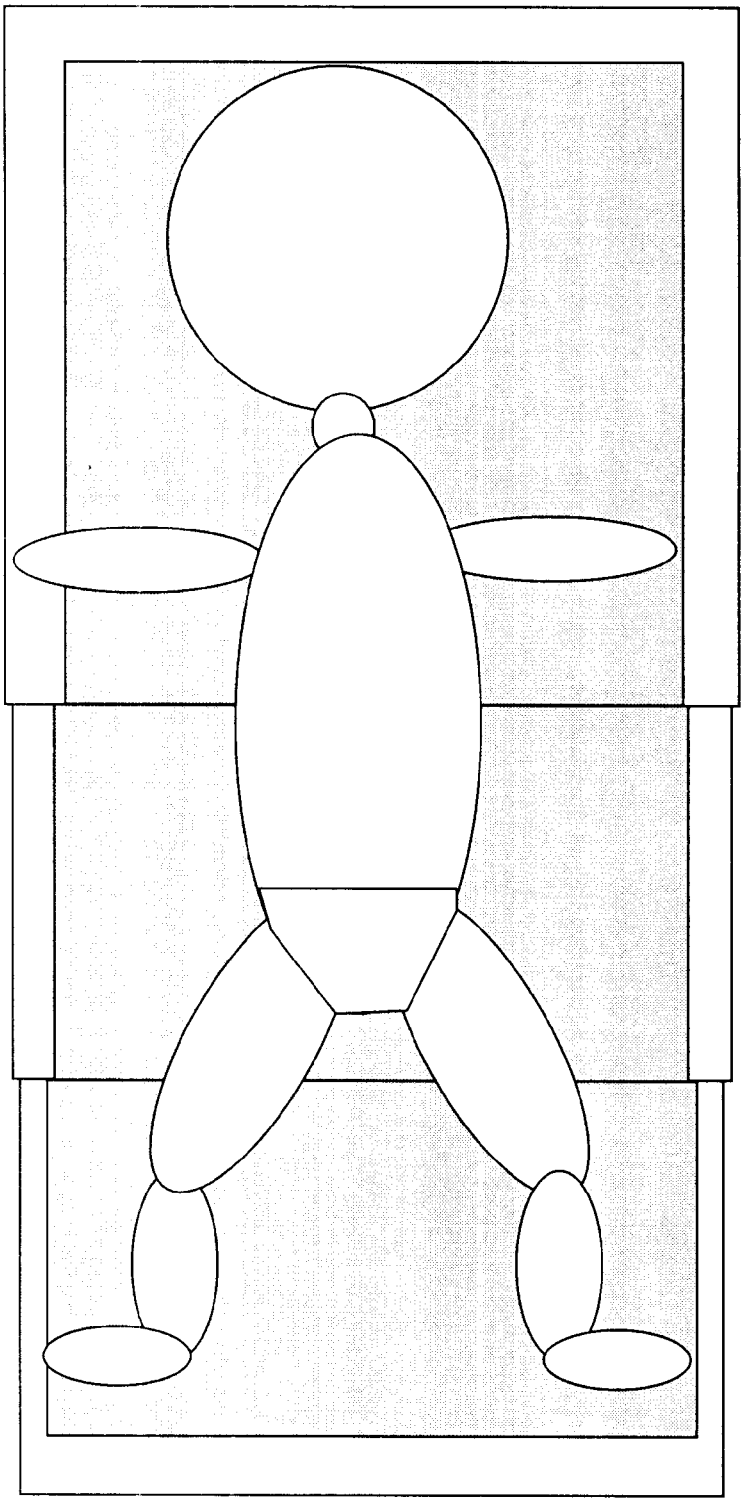
FIG. 10 is a view of the invention of the first embodiment shown in FIG. 1 with a simulated infant resting on the invention to illustrate an envisioned use of the invention.
Figure 11:
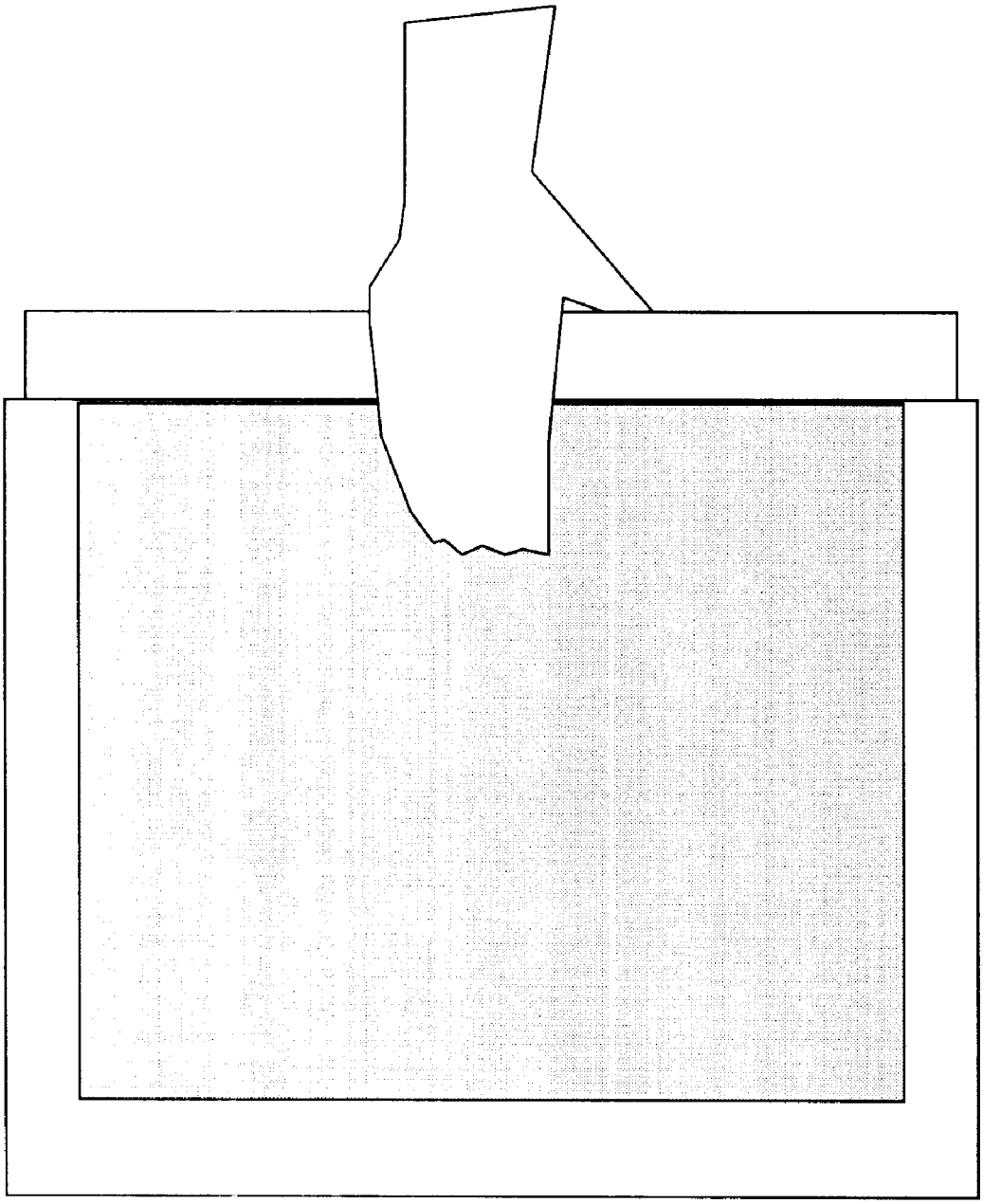
FIG. 11 is a view of the invention of the first embodiment shown in FIG. 1 held in a hand to illustrate portability.

As shown in the drawings for the purposes of illustration the invention is embodied in an apparatus that creates a surface to aid a standard caregiver in the administration of care to an infant. In a preferred embodiment of the present invention, the apparatus is adapted to enable the caregiver to change an infant in their lap. However it will be recognized that further embodiments may be used to allow the caregiver to administer care on various surfaces and in various situations. The apparatus may also be designed from as few as two rectangular members or more than three rectangular members so that it may be collapsible to varied sizes allowing for different degrees of mobility and storage.

The apparatus consists of an inner planar member 10, a hollow middle planar member 20 and a hollow outer planar member 30. The inner planar member 10 has a front border 40, a back border 50 and a left border 60. The outer face 41 of the front border 40 of the inner planar member 10 has a front tab 44. The outer face 51 of the back border 50 of the inner planar member 10 has a back tab 54. The hollow middle planar member 20 has a front border 70 and a back border 80. The outer face 71 of the front border 70 of the hollow middle planar member 20 has an oval cutout 76, and a front tab 74. The outer face 81 of the back border 80 of the hollow middle planar member 20 has an oval cutout 86, and a back tab 84. The hollow outer planar member 30 has a front border 90, a back border 100 and a right border 110. The outer face 91 of the front border 90 of the hollow outer planar element 30 has an oval cutout 96. The outer face 101 of the back border 100 of the hollow outer planar member 30 has an oval cutout 106.

The apparatus provides a surface for the caregiver to administer care by connecting the inner planar member 10, the hollow middle planar member 20 and the hollow outer planar member 30 in the following manner: the right edge 13 of the inner planar member 10 fits inside the left edge 24 of the hollow middle planar member 20, the front tab 44 of the inner planar member 10 fits inside the oval cutout 76 of the outer face 71 of the front border 70 of the hollow middle planar member 20 and the back tab 54 of the inner planar member 10 fits inside the oval cutout 86 of the outer face 81 of the back border 80 of the hollow middle planar member 20. The right edge 23 of the hollow middle planar member 20 fits inside the left edge 34 of the hollow planar outer member 30, the front tab 74 of the hollow middle planar member 20 fits inside the oval cutout 96 of the outer face 91 of the front border 90 of the hollow outer planar member 30 and the back tab 84 of the hollow middle planar member 20 fits inside the oval cutout 106 of the outer face 101 of the back border 100 of the hollow outer planar member 30.

The aforementioned method of connecting the inner planar element 10, the hollow middle planar element 20 and the hollow outer planar element 30 allows the inner planar element 10 to be pushed inside the hollow middle planar element 20 and consequently the inner planar element 10 pushed inside the hollow middle planar element 20, can be pushed inside the hollow outer planar element 30 allowing the size of the apparatus to be reduced allowing for mobility and storage.

In a preferred embodiment the top of the inner planar element 11, the top of the hollow middle planar element 21 and the top of the hollow outer planar element 31 have a surface that allows for greater ergonomic comfort to the caregiver and the infant. To accomplish this the top of the planar elements can be padded.

The invention has now been fully described. While the invention has been described with reference to specific embodiments, the invention should not be construed to be so limited. Various modifications can be made by those of ordinary skill in the art with the benefit of this disclosure without departing form the spirit of the invention. Therefore the invention should not be limited by the specific embodiments used to illustrate it but only by the scope of the appended claims.

What is claimed is:

1. An apparatus to aid in the administration of care to an infant, the apparatus comprising:

an inner planar element with a front edge, a back edge, a left edge, a right edge, a top and a bottom, the back edge is raised and thickened to form a back border along the back edge, the back border with a top face, an outer face and an inner face, the front edge is raised and thickened to form a front border along the front edge, the front border with a top face, an outer face and an inner face, the left edge is raised and thickened to form a left border along the left edge, the left border with a top face, an outer face and an inner face, a front tab projects from the rightmost side of the outer face of the front border, a back tab projects from the rightmost side of the outer face of the back border;

a hollow middle planar element with a front edge, a back edge, a left edge, a right edge, a top and a bottom, the back edge is raised and thickened to form a back border along the back edge, the back border is hollow with a top face, an outer face and an inner face, the front edge is raised and thickened to form a front border along the front edge, the front border is hollow with a top face, an outer face and an inner face, an oval area is cut out of the outer face of the front border, a front tab projects from the rightmost side of the outer face of the front border, an oval area is cut out of the outer face of the back border, a back tab projects from the rightmost side of the outer face of the back border;

a hollow outer planar element with a front edge, a back edge, a left edge, a right edge, a top and a bottom, the back edge is raised and thickened to form a back border along the back edge, the back border is hollow with a top face, an outer face and an inner face, the front edge is raised and thickened to form a front border along the front edge, the front border is hollow with a top face, an outer face and an inner face, the right edge is raised and thickened to form a right border along the right edge, the right border with a top face, an outer face and an inner face, an oval area is cut out of the outer face of the front border, an oval area is cut out of the outer face of the back border; and means for enabling said inner planar element, hollow middle planar element and hollow outer planar element to be joined to form a continuous surface sized to support an infant while additionally permitting the inner planar element to be oriented inside the hollow middle planar element and allowing said inner planar element oriented inside the hollow middle planar element to be oriented inside the hollow outer planar element.

2. The apparatus of claim 1 wherein said means comprises:

the right edge of the inner planar element fits inside the left edge of the hollow middle planar element, the front tab that projects from the rightmost side of the outer face of the front border of the inner planar element fits within the oval area cut out of the outer face of the front border of the hollow middle planar element and the back tab that projects from the rightmost side of the outer face of the back border of the inner planar element fits within the oval area cut out of the outer face of the back border of the hollow middle planar element allowing the inner planar element to retract inside the hollow middle planar element;

the right edge of the hollow middle planar element fits inside the left edge of the hollow outer planar element, the front tab that projects from the rightmost side of the outer face of the front border of the hollow middle planar element fits within the oval area cut out of the outer face of the front border of the hollow outer planar element and the back tab that projects from the rightmost side of the outer face of the back border of the hollow middle planar element fits within the oval area cut out of the outer face of the back border of the hollow outer planar element allowing the hollow middle planar element to retract inside the hollow outer planar element.

3. The apparatus of claim 1 wherein a pad is attached to the top of the inner planar element, a pad is attached to the top of the hollow middle planar element and a pad is attached to the top of the hollow outer planar element.

4. The apparatus of claim 1 wherein the right planar element and the left planar element are made of a lightweight, rigid plastic.

5. The apparatus of claim 1 wherein there are more than two hollow planar elements.

* * * * *